United States Patent [19]

Görike

[11] 4,340,787

[45] Jul. 20, 1982

[54] ELECTROACOUSTIC TRANSDUCER

[75] Inventor: Rudolf Görike, Vienna, Austria

[73] Assignee: AKG Akustische u. Kino-Geräte Gesellschaft-mbH, Austria

[21] Appl. No.: 131,176

[22] Filed: Mar. 17, 1980

[30] Foreign Application Priority Data

Mar. 22, 1979 [AT] Austria ..... 2142/79

[51] Int. Cl.[3] ..... H04R 9/08

[52] U.S. Cl. ..... 179/121 D

[58] Field of Search ..... 179/1 DM, 115.5 PV, 179/121 D

[56] References Cited

U.S. PATENT DOCUMENTS

| | | | |
|---|---|---|---|
| 2,865,464 | 12/1958 | Gorike | 179/121 D |
| 2,939,922 | 6/1960 | Gorike | 179/121 D |
| 3,204,031 | 8/1965 | Gorike | 179/1 DM |
| 3,261,915 | 7/1966 | Gorike | 179/1 DM |

FOREIGN PATENT DOCUMENTS

| | | | |
|---|---|---|---|
| 235918 | 9/1964 | Austria | 179/121 D |

*Primary Examiner*—George G. Stellar

*Attorney, Agent, or Firm*—McGlew and Tuttle

[57] ABSTRACT

An electroacoustic transducer of the electrodynamic type comprises a flat magnetic system permeable to sound including a diaphragm with conducting tracks which are disposed within the system which has a mass provided with conducting tracks substantially equal to the mass of a diaphragm of equal size intended for capacitive transducers. The construction includes acoustic group delay time elements coupled to the diaphragm and a housing defining a shallow depth air chamber at one side of the diaphragm to give the transducer the form of a sound receiver with a unidirectional characteristic.

4 Claims, 4 Drawing Figures

ELECTROACOUSTIC TRANSDUCER

FIELD AND BACKGROUND OF THE INVENTION

This invention relates in general to transducers and in particular to a new and useful transducer of the electrodynamic type having a diaphragm with conducting tracks disposed within a flat magnetic system permeable to sound.

Such electroacoustic transducers are currently used only in head sets, because the surface-driven diaphragm does not tend to partial oscillations and makes possible an undistorted, largely linear, reproduction. Due to the reversibility of the electrodynamic principle, their use as sound receivers is sometimes referred to in the technical literature dealing with transducers of this kind without specifying the construction or acoustic operating characteristics of such a microphone, not to speak of its design as directional sound receiver. It is evident, in view of the improved miniaturization of active and passive electronic component parts, that capacitive transducers, particularly those with an electret diaphragm, are superior to electrodynamic microphones, wherever highest requirements are imposed on quality. An allowance is made for accommodating, in the casing of a capacitive transducer, an amplifier or impedance transformer supplied with current from a battery, also incorporated in the casing or through the microphone cable. Either of those manners of supply may cause disturbances. For example, with a failure of the battery due to an oversight, such as failing to timely switch off the battery, no exchange may be available. With a supply through the microphone cable, not only is an amplifier with a corresponding connection needed but interruptions may also occur in the high-duty microphone cable, preventing the use of the microphone.

SUMMARY OF THE INVENTION

The invention is directed to an electrodynamic transducer usable as a microphone, particularly a directional microphone having transmission properties, particularly responsiveness to pulses, which correspond to a large extent to those of a capacitive transducer, but requiring no electronic component parts in their casing and being substantially now susceptible to disturbances because of their low-impedance output.

In accordance with the invention, an electrodynamic transducer for use as a microphone includes a microphone housing with a diaphragm extending across the housing and with base plates spaced on respective sides of the housing have a plurality of bar magnets therealong forming acoustic delay time elements which are coupled to the diaphragm. On the rear side of the diaphragm there is a shallow depth housing defining a cavity which contains acoustic resistance. Advantageously, the diaphragm also connects to a large cavity through a connecting tube or similar element which may also include a perforated wall having frictional resistances adjacent the perforations.

As compared to prior art electrodynamic microphones with a voice coil, the invention has the advantage that the diaphragm can be coupled to acoustic delay elements in a simpler and substantially trouble free manner, so that a better directional characteristic is obtained. However the responsiveness to pulses of the inventive transducer is far better than that of the voice-coil microphone, as may become evident from the following considerations:

The diaphragm provided in the invention, with conducting tracks printed on, and made, for example, from an extremely thin plastic foil, has approximately one-tenth of the mass of a diaphragm with a voice coil. If now the corresponding values for a diaphragm having a diameter of 3 cm are introduced into the formula for the radiation resistance Rs of a diaphragm having a circular circumference, $$Rs=(\rho\cdot\pi\cdot r^{u}\omega^{2})/2c$$

where $\rho$=air density=$1.2\times10^{-3}$ cgs r=diameter of the diaphragm in cm c=velocity of sound=344 m/s the resulting radiation resistance is Rs=0.11 for 100 Hz, Rs=0.44 for 200 Hz and Rs=11 for 1000 Hz The logarithmic decrement follows from the formula $$d=(R\cdot\pi)/(M\cdot W_o)$$

The mass of a diaphragm with a voice coil and having a diameter of 3 cm is about 0.12 grams, while the mass of a diaphragm of equal size and of sheet-like form is only 0.012 grams. If the values are introduced into the above formula, a decrement of d=0.045 results for a diaphragm with a voice-coil but a decrement of d=0.45 for the sheet-form diaphragm. This value already substantially contributes to the attenuation of the oscillatory system, particularly if a predominantly mass-retarded system is involved, while with a voice-coil diaphragm, the value of 0.045 does not produce any substantial effect upon the damping. In practice, this weak damping results in a disturbing sensitivity of the microphone to mechanical impulses acting on the casing from the outside, and to air pressure pulses such as occurring during close-talk voice control. The inventive transducer with the light flat diaphragm does not show these drawbacks. Its particular advantage, however, is the high fidelity of pulse reproduction which is clearly perceptible during a transmission of music or speech. The ribbon microphone, also numbering among the electrodynamic transducers, where the oscillatory system is represented by an about 2 microns thick metallic ribbon, is also very well responsive to pulses, because of the extremely light ribbon. It is hardly possible, however, to prevent the ribbon from relaxation oscillations producing transmission errors. In the inventive transducer, which substantially comprises only a radially slightly stretched, extremely thin diaphragm, such difficulties do not occur. To summarize, it may be stated that the inventive transducer, designed as a directional microphone, is equivalent to a condenser microphone both in its frequency and phase characteristic, and in its responsiveness to pulses.

Since the inventive transducer operates on the electrodynamic principle, delay time elements must be provided checking the diaphragm to the effect of making the attentuation factor independent of the frequency. In a voice-coil microphone, lining up resonance circuits is a hardly satisfactory way for complying with the requirement of a frequency-independent attenuation factor, because of the mass of the oscillatory system. In addition, to enlarge the frequency range upwardly, Helmholtz resonators must be provided in front of the diaphragm.

In the transducer, in accordance with the invention, where the mass of the flat diaphragm is only a tenth of the mass of a diaphragm with a voice-coil, connections to acoustic delay elements are as immune to interferences as in a capacitive transducer. In principle, acoustic delay elements of the RC or LR type in an electrostatic transducer and an electrodynamic transducer are similar to each other, as far as identical directional characteristics are provided, only their dimensioning is different in practice. If a unidirectional characteristic is provided, which may be derived from a vectorial addition of an omnidirectional and a figure-eight characteristic, in an elongated microphone (such as a condenser microphone), the oscillatory system must be checked elastically for an omnidirectional characteristic, while a frictional checking is needed for the figure-eight characteristic. In a radient microphone, thus an electrodynamic system such as the inventive transducer, frictional and mass checking is to be provided for a unidirectional characteristic. This means that with identical diaphragm surface areas, the capacitive elements of the delay line, thus the cavity volumes, must be about 30 to 100 times larger in an electrodynamic transducer than in an electrostatic one. This requirement, however, can easily be met, since in a capacitive transducer of 32 mm in diameter, for example, the cavity volumes amount to only about 0.2 $cm^3$, so that in a pressure-gradient microphone, the above indicated requirement can be satisfied without making the microphone too bulky. Aside therefrom, further development of the technology of printed circuits is to be expected in the near future, so that diaphragm surface areas below 8 $cm^2$ may be obtained by reducing the width of the tracks and the spacing therebetween. This not only further reduces the mass of the diaphragm but also results in a more favorable internal resistance of the transducer, namely between 200 and 600 ohms.

It may be learned from the following description of some embodiments of the invention that with the inventive design, the coupling of acoustic elements, for example, the cavities, frictional resistances, or acoustic masses, can be effected by a substantially more clear and precise arrangement than in conventional moving-coil microphones. What becomes particularly simple with the inventive light diaphragm is the upward extension of the frequency range to the highest frequencies, since due to the flat configuration of the diaphragm, a very shallow air chamber with an incorporated acoustic attenuator can be provided at the rear side thereof. The restoring force of the attenuator furnishes a wide resonance curve extending over about 2 octaves at the upper limit of the transmission range. This makes unnecessary the provision of a Helmholtz resonator, needed in voice-coil microphones and causing in addition a steep drop of the frequency response above its natural frequency.

In the first shown embodiment of the invention, the shallow air chamber behind the diaphragm is bounded, on its side remote from the diaphragm, by a large surface acoustic frictional resistance limiting, on its other side, a large cavity which is acoustically effective in the low frequency range. In addition, a slotted tube with apertures which are distributed over the length of the tube and provided with frictional resistances, connects the shallow air chamber to the outside, and this design contributes to the unilateral directional characteristic.

In another embodiment of the invention, an acoustic frictional resistance is provided on the perforated base plate of the magnetic system, which plate extends adjacent the rear side of the diaphragm. This frictional resistance connects to a chamber communicating with the outside through a frictional resistance. Further, directly connected to the base plate is a tube opening into a large cavity which is acoustically effective in the low-frequency range. This embodiment shows how simple the design of the inventive transducer equipped with the flat magnetic system can be.

This also is demonstrated by an embodiment in which the perforated base plate belonging to the magnetic system and adjacent the rear side of the diaphragm carries a frictional resistance connecting to a cylindrical cavity formed by a casing which is provided with apertures distributed over its outer wall and provided with frictional resistances, and which is closed on its front face remote from the transducer system by a frictional resistance.

In the last shown embodiment designed with a clear arrangement and in a simple manner which can hardly be further improved, the rear side of the diaphragm communicates, through a shallow air chamber, with an annular, cylindrical channel whose outer wall is provided with distributed apertures leading to the outside and closed by frictional resistances. The shallow air chamber also is closed on its front face remote from the rear side of the diaphragm by a frictional resistance connecting to a closed chamber which is acoustically effective in the mid and higher frequency range. Further provided is a cavity which is acoustically effective in the low frequency range and communicates with the outside through an aperture provided with a frictional resistance. This cavity also communicates, through a short pipe connection, with the shallow air chamber behind the diaphragm.

Accordingly it is an object of the invention to provide an electroacoustic transducer of the electrodynamic type which comprises a flat magnetic system permeable to sound with a diaphragm with conducting tracks disposed in the system having a mass provided with the conducting tracks substantially equal to the mass of a diaphragm of equal size intended for capacitive transducers and further including acoustic group delay time elements coupled to the diaphragm and means defining a shallow depth air chamber at the rear side of the diaphragm to give the transducer the form of a sound receiver with unidirectional characteristics.

A further object of the invention is to provide an electrodynamic transducer for use as a microphone which comprises a diaphragm housing with a diaphragm extending across the housing with the housing having acoustic delay time elements adjacent to and acoustically coupled to the diaphragm and including a base plate on each side of the diaphragm and spaced from the diaphragm, a plurality of magnets associated with the base plates and chamber forming means defining a shallow depth air chamber on one side of the diaphragm overlying at least the portion of the associated one of the base plates and an acoustic resistance associated with the chamber forming means.

A further object of the invention is to provide an electromagnetic transducer for use as a microphone which is simple in design, rugged in construction and economical to manufacture.

The various featurea of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF PREFERRED EMBODIMENTS

Figure 1:
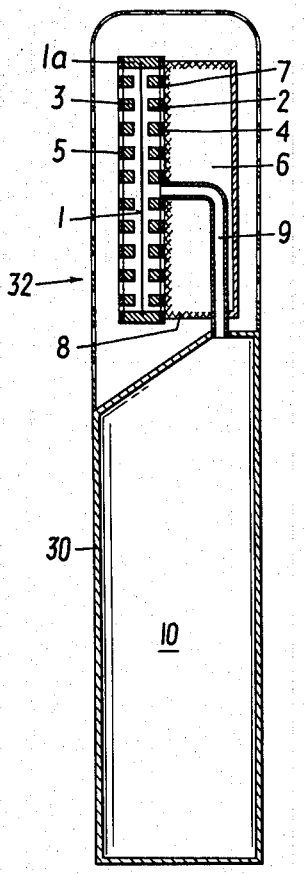
FIG. 1 is a diagrammatic sectional view of a transducer in a microphone constructed in accordance with the invention.

Referring to the drawings in particular the invention embodied therein in FIG. 1 comprises a microphone generally designated 32 having an electroacoustic transducer of the electrodynamic type which comprises a diaphragm 1 in a housing 1*a*. The housing 1*a* includes perforated base plates 4 and 5 at spaced locations from the diaphragm having a plurality of magnets 3 and 2 respectively distributed along their surfaces and acoustically coupled to the diaphragm. Chamber forming means define a cavity 6 adjacent the base plate 4. The cavity 6 is coupled to the diaphragm through an acoustic sectional resistance 7. The cavity is provided with a frictional resistance 8 on a wall of the cavity 6 which communicates to the outside. A tube 9 is centrally connected to the base plate 4 so that the diaphragm 1 can transmit low frequency sound waves to large cavity 10 defined within a housing 30. The delay time elements comprise the resistance 8, the cavity 6, an acoustic sectional resistance 7 adjacent the interior side base plate 4 and the tube 9 and the large cavity 10.

Figure 2:
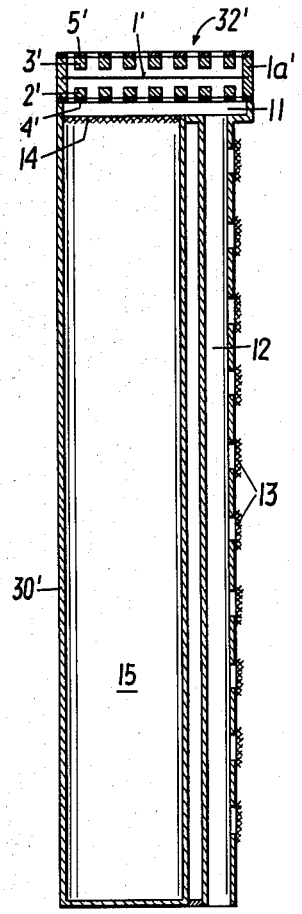
FIG. 2 is a view similar to FIG. 1 of another embodiment of the invention.

In the embodiment shown in FIG. 2 similar parts are similarly designated but with a prime. In this embodiment adjacent a base plate 4' there is a shallow depth air chamber 11 which communicates with the exterior of the transducer, also referred to as outside, through a slotted tube 12 having sound apertures and frictional resistances 13. Joining the shallow depth chamber 11 is an acoustical frictional resistance 14 which connects to a large size cavity 15. The time delay line for developing the unidirectional characteristic is formed by tube 12, frictional resistance 14 and cavity 15.

Figure 4:
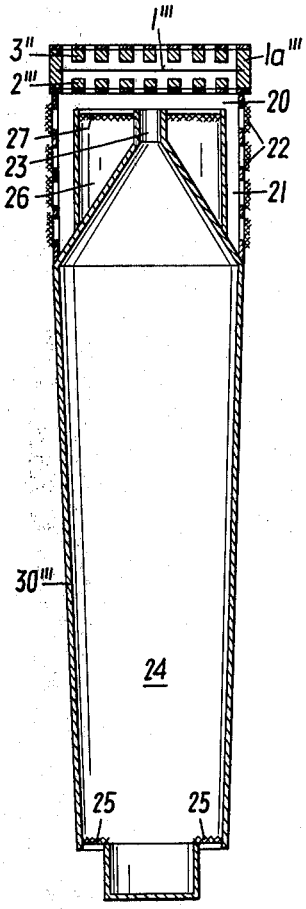
FIG. 4 is a view similar to FIG. 1 of still another embodiment of the invention.
Figure 3:
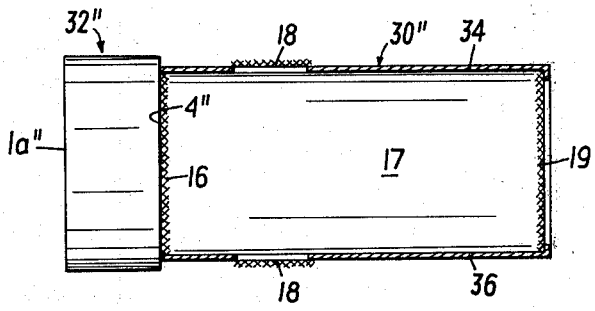
FIG. 3 is a view similar to FIG. 1 of still another embodiment of the invention.

In the embodiment of FIG. 3 similar parts are shown with double primes after them. In this embodiment a microphone 32'' includes a microphone 32'' having a housing part 30'' and a frictional resistance 16 at the interior side of a base plate 4'' adjoining a cavity 17 in the housing 30''. Apertures distributed on side walls 34 and 36 of the housing part 30'' have frictional resistances 18 and 19 which develop a unidirectional characteristic only in a reduced frequency range. In the embodiment of FIG. 4 similar parts are designated with three primes. This embodiment includes an elongated microphone 32''' with an axial speaking direction. The transducer system is connected through a shallow air chamber 20, to an annular cylindrical channel 21 having distributed apertures with frictional resistances leading to the outside. A pipe connection 23 enclosing an acoustic mass is connected centrally to the chamber 20 and leads to a larger chamber 24. An acoustical frictional resistance 25 connects to the outside. Shallow chamber 20 communicates through a frictional resistance 27 with the chamber 26.

Two delay lines are provided. They comprise the elements 22, 27 and 26 which are effective in the mid and high frequency range and elements 25, 24 and 23 which are effective in the low frequency range.

While specific embodiments of the invention have been shown and described in detail to illustrate the application of the principles of the invention, it will be understood that the invention may be embodied otherwise without departing from such principles.

What is claimed is:

1. An electroacoustic transducer of the electrodynamic type, comprising a flat magnetic system permeable to sound including a diaphragm, said diaphragm having a mass provided with conducting tracks, said mass of said diaphragm being substantially equal to the mass of a diaphragm of equal size intended for capacitive transducers, means defining a shallow depth chamber at the interior side of said diaphragm, and acoustic group delay time elements coupled to said diaphragm to give the transducer the form of a sound receiver with unidirectional characteristics, a perforated base plate on each side of said diaphragm, an acoustic frictional resistance connecting said shallow depth chamber with said diaphragm, a housing part defining a large cavity, a tube extending from said large cavity to one of said perforated base plates and said diaphragm, said tube and said large cavity being acoustically effective in the low frequency range and being directly connected to said base plate.

2. An electroacoustic transducer according to claim 1, wherein said acoustic frictional resistance is mounted to said base plate adjacent the interior side of said diaphragm, said tube extending to the perforated base plate adjacent the interior side of said diaphragm.

3. An electrodynamic transducer for use as a microphone, comprising a diaphragm housing, a diaphragm extending across said housing, said housing having acoustic delay time elements adjacent to and acoustically coupled to said diaphragm including a perforated base plate on each side of and spaced from said diaphragm, a plurality of magnets arranged at spaced locations along said base plate, chamber forming means defining a shallow depth air chamber on one side of said diaphragm overlying at least a portion of the associated one of said base plates, a housing part defining a large cavity connected through said shallow depth chamber to said diaphragm, said shallow depth chamber communicating to the outside and having acoustic resistance therein, a tube extending from said large cavity through said shallow depth chamber and through said base plate communicating said large cavity to said diaphragm, said shallow depth chamber having one wall with an opening therein and having an acoustic resistance adjacent said opening and adjacent said base plate.

4. An electrodynamic transducer for use as a microphone, comprising a diaphragm housing, a diaphragm extending across said housing, said housing having acoustic delay time elements adjoining to and acoustically coupled to said diaphragm including a perforated base plate on each side of and spaced from said diaphragm, a plurality of magnets arranged at spaced locations along said base plate, chamber forming means defining a shallow depth air chamber on one side of said diaphragm overlying at least a portion of the associated one of said base plates, a housing part defining a large cavity connected through said shallow depth chamber to said diaphragm, a central tubular member connecting said large cavity with said shallow depth chamber, means defining another chamber adjacent and at least partially surrounding said central tubular member having acoustic resistance connecting said another chamber to said shallow depth chamber and an apertured tubular channel adjacent to and at least partially surrounding both said shallow depth chamber and said another chamber and opening to the outside and having acoustic resistances.

* * * * *